US011186984B1

(12) United States Patent
Webb

(10) Patent No.: US 11,186,984 B1
(45) Date of Patent: Nov. 30, 2021

(54) LATCH LOCK FOLDABLE FLOORING SYSTEM

(71) Applicant: Stephen C. Webb, Wasilla, AK (US)

(72) Inventor: Stephen C. Webb, Wasilla, AK (US)

( * ) Notice: Subject to any disclaimer, the term of this patent is extended or adjusted under 35 U.S.C. 154(b) by 0 days.

(21) Appl. No.: 16/815,851

(22) Filed: Mar. 11, 2020

(51) Int. Cl.

| | |
|---|---|
| ***E04B 2/00*** | (2006.01) |
| ***E04B 1/38*** | (2006.01) |
| ***E04B 5/00*** | (2006.01) |
| ***E04F 15/02*** | (2006.01) |

(52) U.S. Cl.
CPC ..... *E04B 1/38* (2013.01); *E04B 5/00* (2013.01); *E04F 15/02* (2013.01); *E04F 2201/0138* (2013.01)

(58) Field of Classification Search
CPC ..... E04H 1/1205; E04B 1/3442; E04B 1/344; E04B 1/3445; E04B 1/3441; E04B 1/3205; E04B 7/105; E04B 7/10; E04B 2001/3241; E04B 1/003; Y10T 16/5474; Y10T 16/5472; F24D 3/142
USPC ..... 52/79.9, 79.6, 79.5, 87, 782.1, 782.23, 52/782.24, 64, 65, 68–71; 237/69
See application file for complete search history.

(56) References Cited

U.S. PATENT DOCUMENTS 3,398,850 A * 8/1968 Kennard ..... E04B 1/3445 220/6
5,444,944 A * 8/1995 Roelofsz ..... E04B 1/3445 52/64
5,493,818 A * 2/1996 Wilson ..... E04B 1/3445 52/71
8,209,916 B2 * 7/2012 Herron ..... E04B 2/12 52/79.5
8,763,315 B2 * 7/2014 Hartman ..... E04B 1/34357 52/79.5
2008/0163564 A1 * 7/2008 Jarski ..... A47B 77/02 52/69
2012/0317898 A1 * 12/2012 Strachan ..... E04B 1/34869 52/79.5
2014/0033621 A1 * 2/2014 Vidal ..... E04B 1/3445 52/79.5
2014/0144088 A1 * 5/2014 Heger ..... E04B 1/34357 52/79.5
2014/0152685 A1 * 6/2014 Iwaki ..... G09G 5/32 345/589
2016/0153183 A1 * 6/2016 Richter ..... E04B 1/34384 52/79.5
2019/0071859 A1 * 3/2019 Gill ..... G10K 11/162
2020/0071925 A1 * 3/2020 Shum ..... E04B 1/348

* cited by examiner

*Primary Examiner* — Chi Q Nguyen
(74) *Attorney, Agent, or Firm* — Michael J. Tavella

(57) ABSTRACT

A flooring system that folds up to form a large crate. This crate can be used to hold constructions materials for the building to be built on the floor. The crate is designed to be placed on a foundation. The crate is placed on top of the foundation in the center, perpendicular to beams that make up part of the foundation. Once the base is in place on the beams the crate is unfolded and a flat floor is achieved. All of the pieces of the crate have the flanges that fit onto the beams. They can then be fastened to the beams to secure them in place. The system uses a unique hinge and locking system. At the edges of the sides of each floor panel of the crate are torque tubes that support a cam link and a cam arm that are used to fold and unfold the floor.

19 Claims, 11 Drawing Sheets

LATCH LOCK FOLDABLE FLOORING SYSTEM

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to flooring systems and particularly to flooring systems that are hingeably attached to form a foldable floor structure.

2. Description of the Prior Art

Floors have been used in buildings for centuries. They have developed from simple planks nailed to supports, to complex systems that are designed to be quickly assembled in a greenfield setting. Many buildings have been supported on pilings driven into the ground at regular intervals. These pilings are then cut and covered by beams, onto which a flooring system is built. Other systems use more sophisticated pilings that are precisely laid out. An example of such a flooring system is found in U.S. Pat. No. 8,528,296 to Miller. This system uses a set of piers onto which a number of square frames are attached. These frames are then covered by a suitable flooring material particular to the building.

The main problem with such systems is that the floor consists of many pieces, which must be transported, sorted out and assembled. This can require a significant number of person hours and the use of expensive equipment.

BRIEF DESCRIPTION OF THE INVENTION

The instant invention overcomes many of the difficulties described above. It is a flooring system that folds up to form a large crate. This crate can be used as a shipping container for construction materials of the building to be built on the floor, such as my panelized portable structure found in U.S. Pat. No. 8,615,934. The crate is designed to be placed on a permanent or temporary foundation or two or more rows. Each row is fitted with a beam that has a bracket system. The center of the crate is placed on top of the foundation's beams. The Flanges on the crate correspond to the positions of the beams. The crate has a base, two vertical sides, two top sections and two end panels. Once the crate is in place on the beams, the end panels are removed, and the crate is unfolded. The two vertical sides abut the base and the two top sections abut the two connected sides. In this way, a flat floor is achieved. The flanges on the top, sides and bottom of the crate fit over the beams. They can then be fastened to the beams to secure them in place.

The system uses a unique hinge and locking system. The sides of adjacent floor panels are connected by a number of hinges. Each hinge is made up of a number of cam arms and torque tubes. Each torque has a bushing and cam secured in each cam arm location. Each cam arm has a curved cam follower. In opening the crate, as a crate wall is rotated, the cam arms move about the torque tubes, with the cam followers resting on the cams, which rotate with the torque tubes, until the flooring panels are almost in alignment. Turning the torque tubes more, causes the cams to rotate downwards, which draws the adjacent panels tightly together. Once snug, the cams continue to rotate with the torque tubes, falling off the cam followers, which causes the cam arms to drop onto the torque tubes, locking the sections together. To fold the floor up the reverse procedure is used.

DETAILED DESCRIPTION OF THE INVENTION

Figure 1:
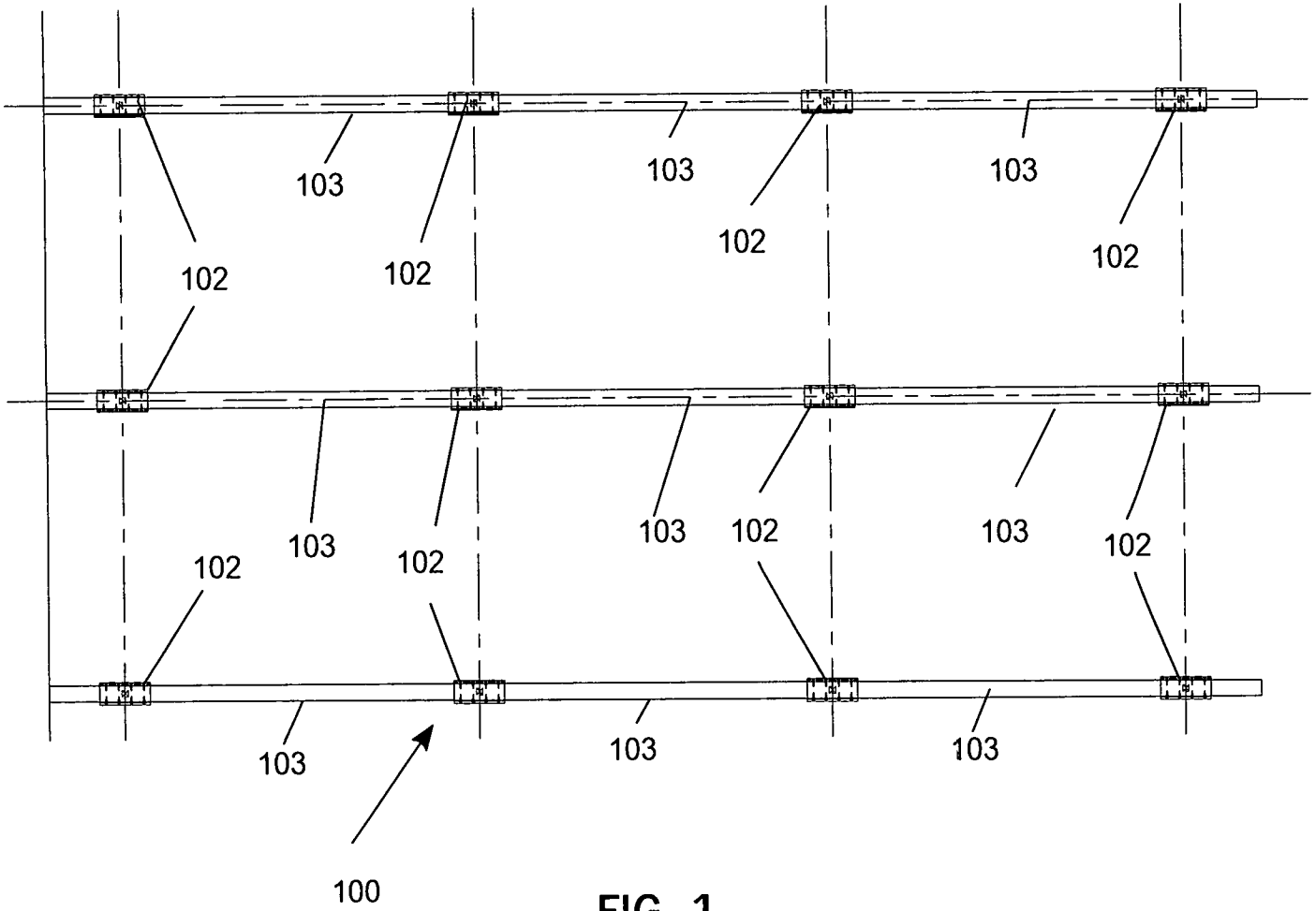
FIG. 1 is a top plan view of the foundation system.
Figure 2:
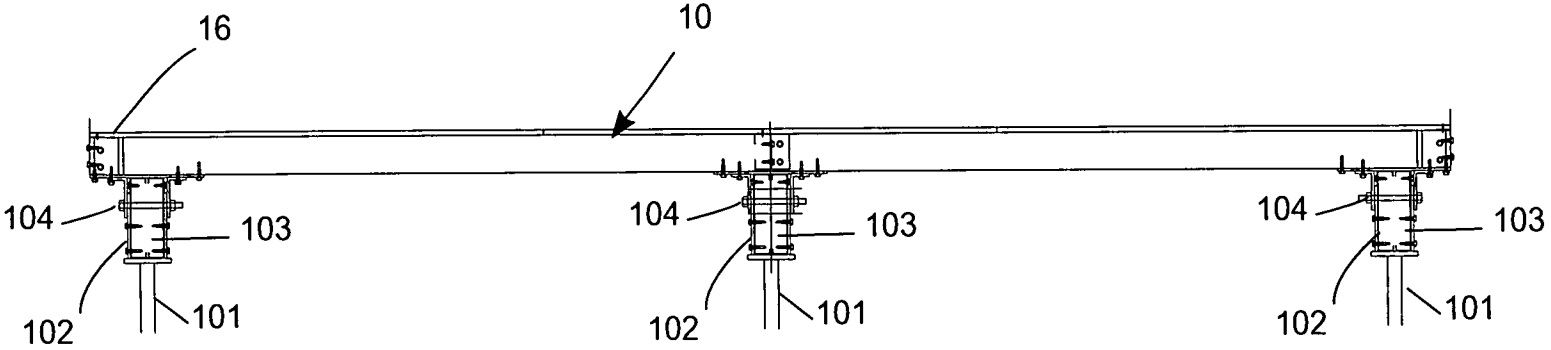
FIG. 2 is an end elevation view of the open flooring system on the foundation.
Figure 3:
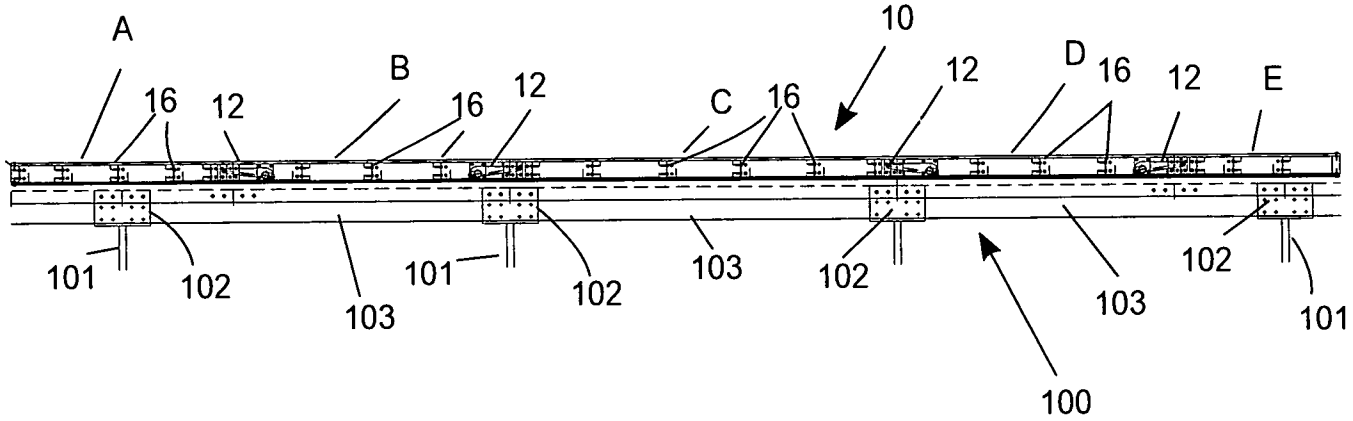
FIG. 3 is a side elevation view of the flooring system, opened on the foundation.

Referring now to the drawings, and especially to FIGS. 1, 2 and 3, a top plan view of the foundation system is shown in FIG. 1. FIG. 2 is an end elevation view of the open flooring system on the foundation. FIG. 3 is a side elevation view of the flooring system, opened on the foundation. This is one type of foundation that can be used with the flooring system. However, any other foundation system that has the necessary support points and beams can be used. The foundation system 100 has a number of posts 101 (FIG. 2) set out in an array as shown. These posts have brackets 102 attached to the tops of the posts as shown in FIGS. 2 and 3. The brackets 102 hold and support beams 103 as shown. The beams 103 are secured to the brackets 102 with fasteners 104 (FIG. 2). The flooring system 10 is secured to the beams 103 as shown in FIGS. 2 and 3. In these views, the flooring system 10 is fully open and in place. In the preferred embodiment, there are five flooring sections: A, B, C, D and E. Details of the flooring system are provided below. In FIG. 3 framing brackets 16 are shown for each flooring section, as described in more detail below. Note too, this figure shows four of the twelve hinges 12 as well.

Figure 4:
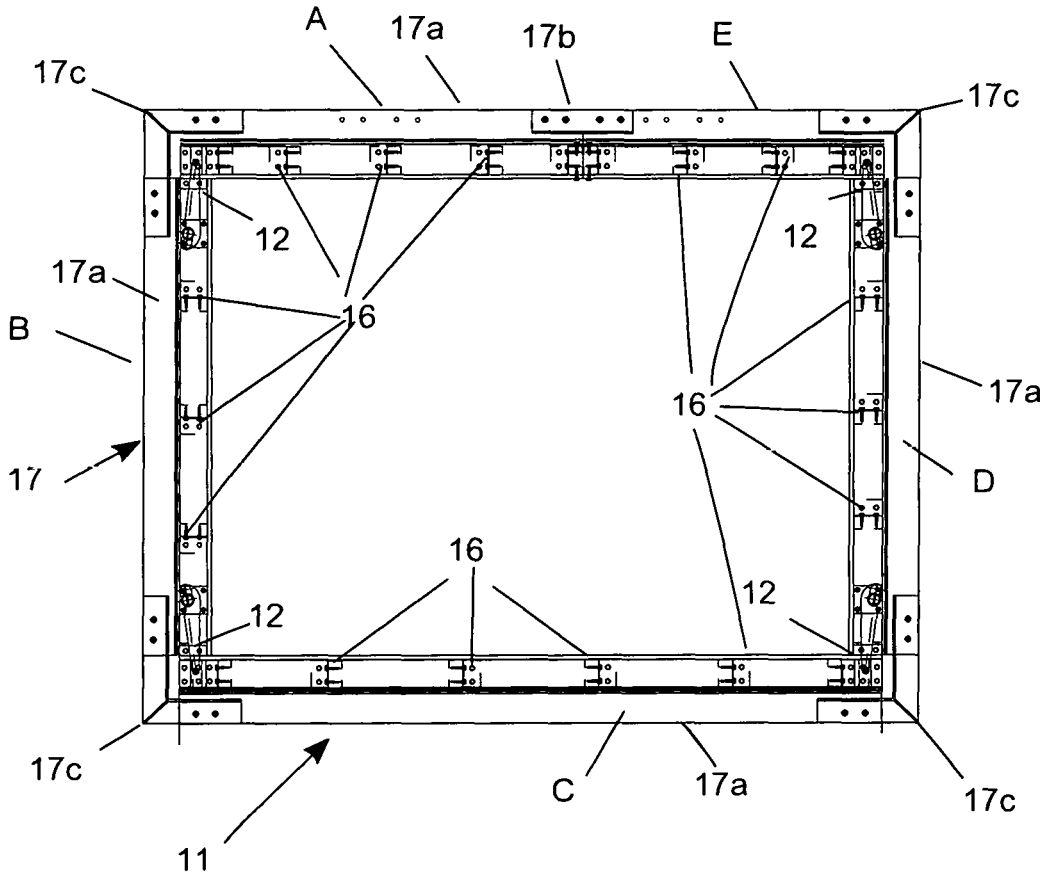
FIG. 4 is a side view of the flooring system folded for transport, forming a box end.

FIG. 4 is a front view of the flooring system folded for transport. The floor system is designed to fold and unfold. This allows the flooring system 10 to begin as a crate 11 that carries the construction materials to the site. At the site, the crate is unfolded along hinge lines to form 5 segments of a floor, as described above. There are four hinge points 12 that have 36 hinges, which are used to open and close the crate 11. As noted above, there are five flooring sections: A, B, C, D and E. Note that sections A and E are shorter that the other sections as shown. They are not of equal length, but their total length is equal to that of segment C. These sections can be made in any particular size, but, due to limitations of truck beds, there are limits. In the preferred embodiment, segments A is four feet wide, segments B and D are each five feet wide. Segment C is seven feet wide and segment E is three feet wide. That means, in the preferred embodiment, the length of the floor is 24 feet long and, when folded, the crate is rectangle of seven feet wide by five feet high. The length of the crate (or width of the floor) can be any reasonable dimension, but 10 to 20 feet being preferred. As noted above, the crate is designed to be fitted to a tractor trailer, so length and weight are the limiting factors for most applications of the invention. Note too that each segment is made up of a frame (see FIG. 5) that is secured by a number of framing brackets 16 as shown.

The details of the hinges and latching system is discussed below.

As shown in FIG. 4, the flooring sections are encased with an outer layer. This outer layer 17 consists of shipping angles 17*a* that may be aluminum, steel, stainless steel, fiberglass, or other similar materials, and latches 17*b* used in shipping. The shipping angles 17*a*, and the corner brace shipping angles 17*c*, are used to brace the box during shipping. The latches 17*b* are used to securely close the crate for shipping. They are removed when the structure is unfolded onto the pile caps and stored for future use or reused for shipping of another structure.

Figure 5:
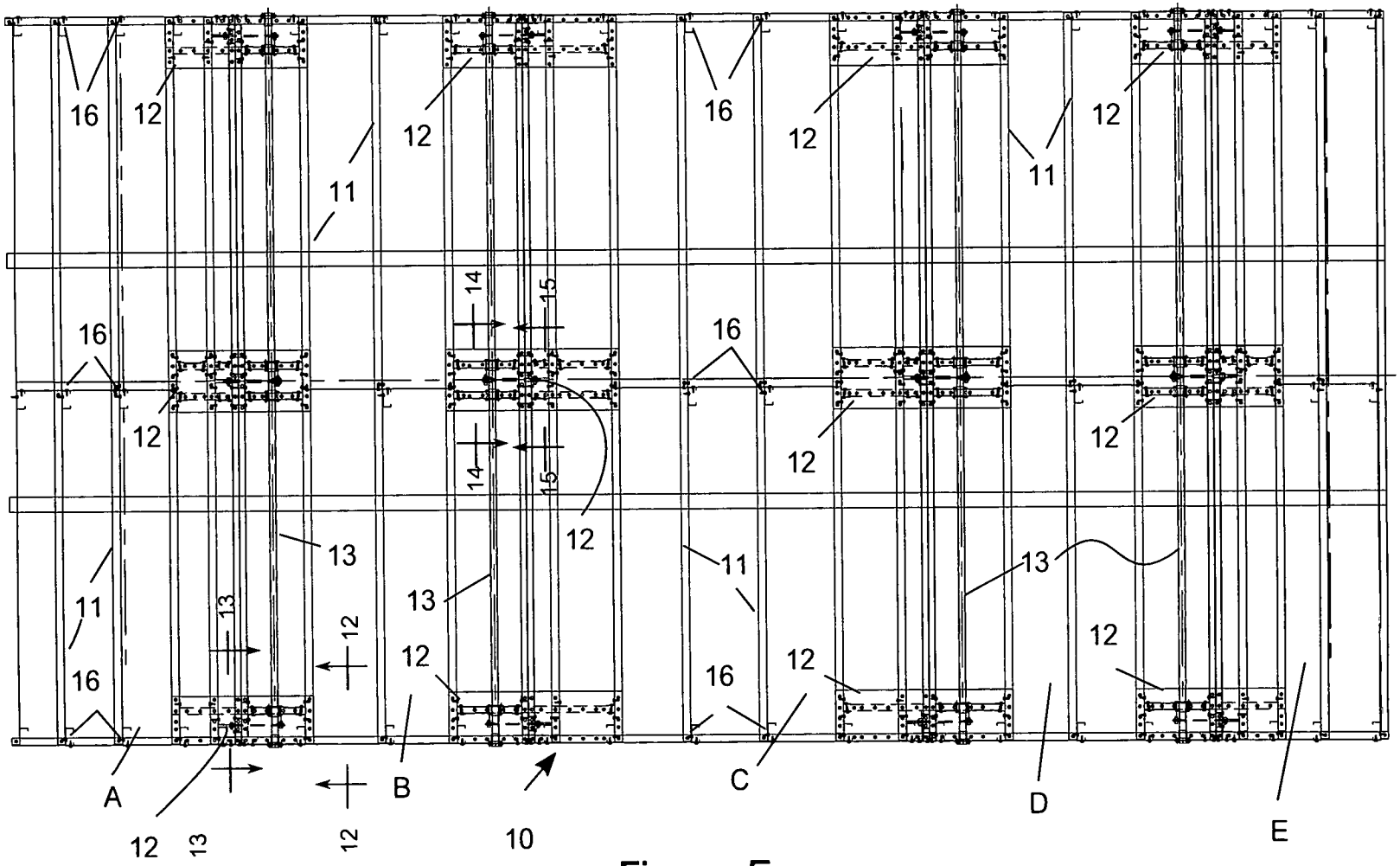
FIG. 5 is top plan view of the flooring system framing detail.

FIG. 5 is top plan view of the flooring system framing detail, shown without the covering top plates. Normally, the flooring system 10 is covered with plywood sheets 14 (see FIG. 5*a*), or other types of flooring materials. Each of the five segments is shown. The segments are joined by hinges 12. The hinges are discussed in greater detail below. As shown, three hinges 12 are spaced along the width of the floor at each segment joint, (see also FIG. 7). Each hinge also has a torque tube 13, which is discussed in greater detail below. The framing consists of joists 11 that are spaced at regular intervals across each segment, which are then supported by the framing brackets 16, as shown.

Figure 5A:
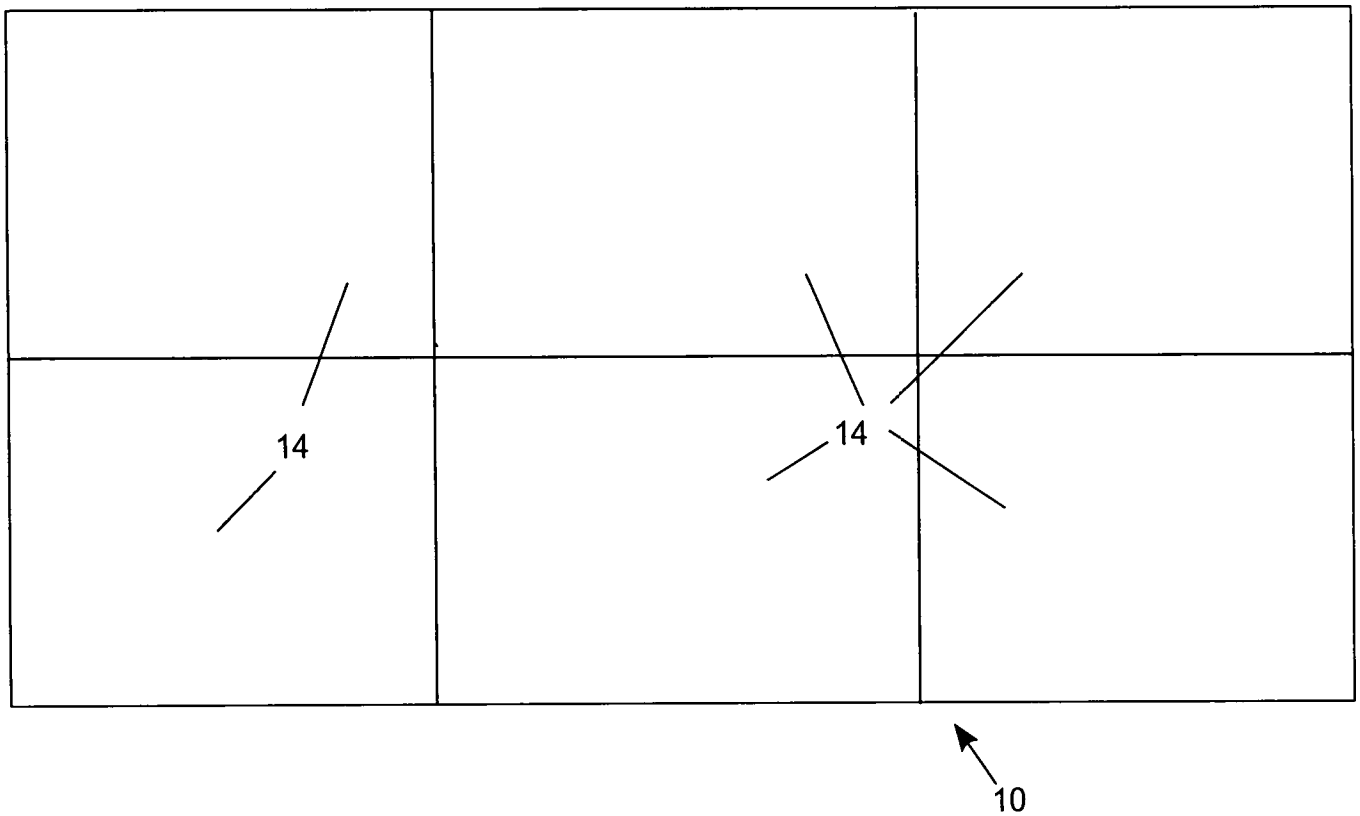
FIG. 5*a* is top plan view of the flooring system with sheathing plates in place.

FIG. 5*a* shows the flooring system with the sheathing in place. Here, the sheathing plates 15 are shown. In the preferred embodiment, the plates are plywood sheets. These sheets can be bare wood or sheets of other materials and can be covered with other flooring materials as desired. Although 6 plates 14 are shown. Any number of plates can be used in any particular size and configuration, depending on the specific size of the floor and the type of materials being used.

Figure 6:
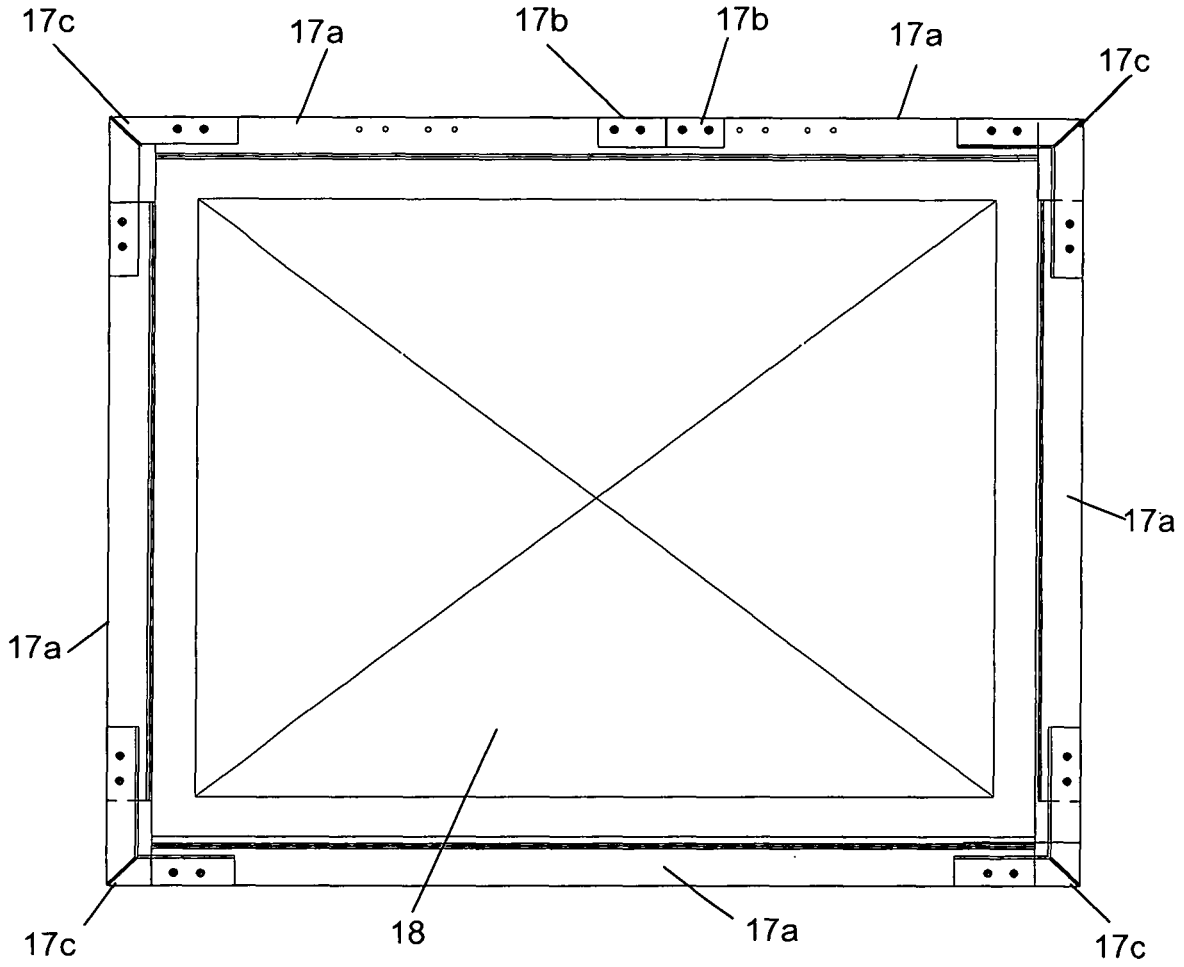
FIG. 6 a detail view of the flooring system folded showing one of the end panels in place to form a sealed storage crate.

FIG. 6 a detail view of the folded flooring system sealed to form a crate. As discussed above, the floor system is designed to fold into a crate. As noted above, the shipping angles 17*a*, locking angles 17*b* and corner shipping brace angles 17*c* are shown. One of the two end panels 18 is shown in place. These end panels seal the contents of the crate (the building materials for the structure, for example) to hold and protect the contents. The crate covers 18 are removed and stored with the shipping angles and locks.

Figure 7:
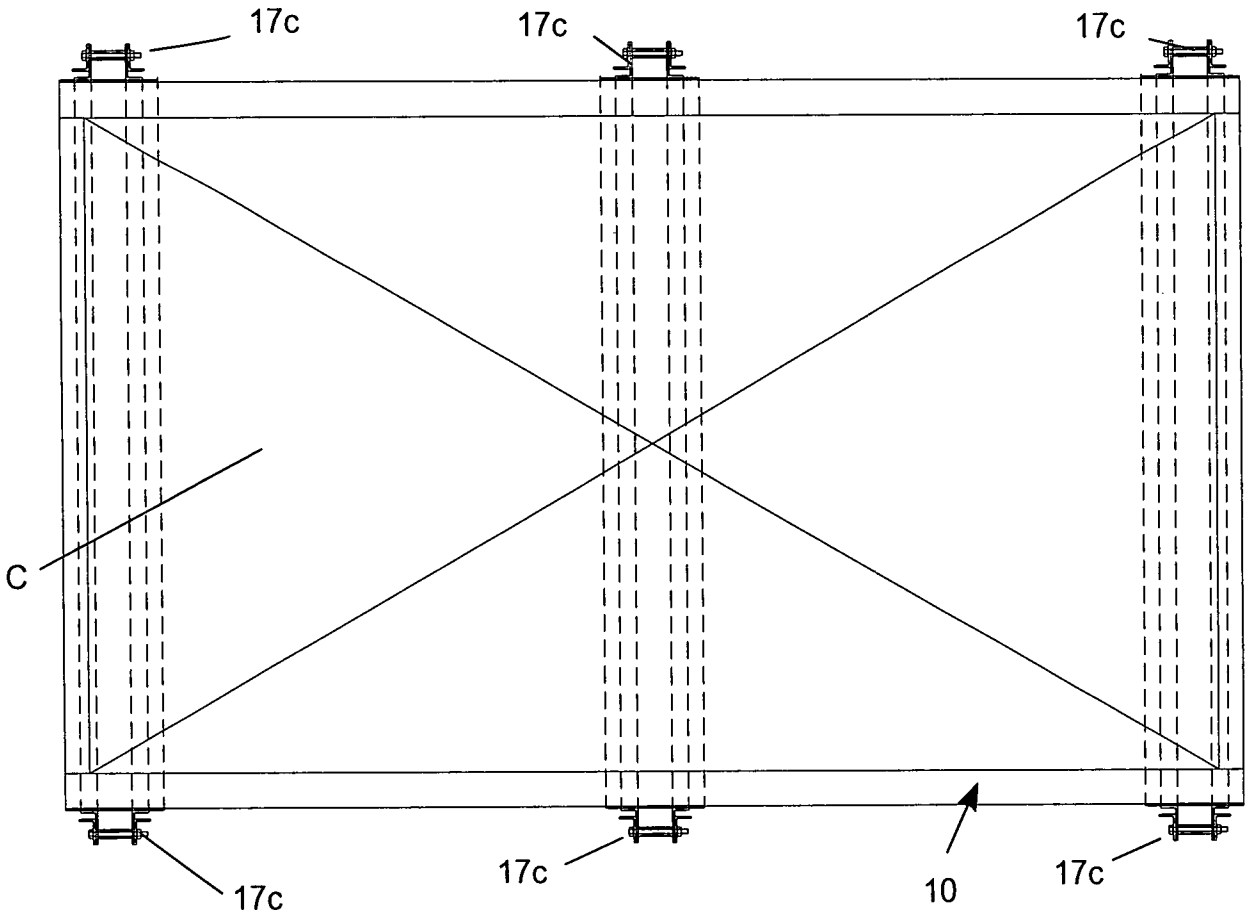
FIG. 7 is a bottom view of the bottom of the closed crate.

FIG. 7 is a bottom plan view of the closed crate. In this view, the shipping corner angles 17*c* are shown on the outside of the crate. The floor system is inside the crate and segment C of the flooring system is shown.

Figure 7A:
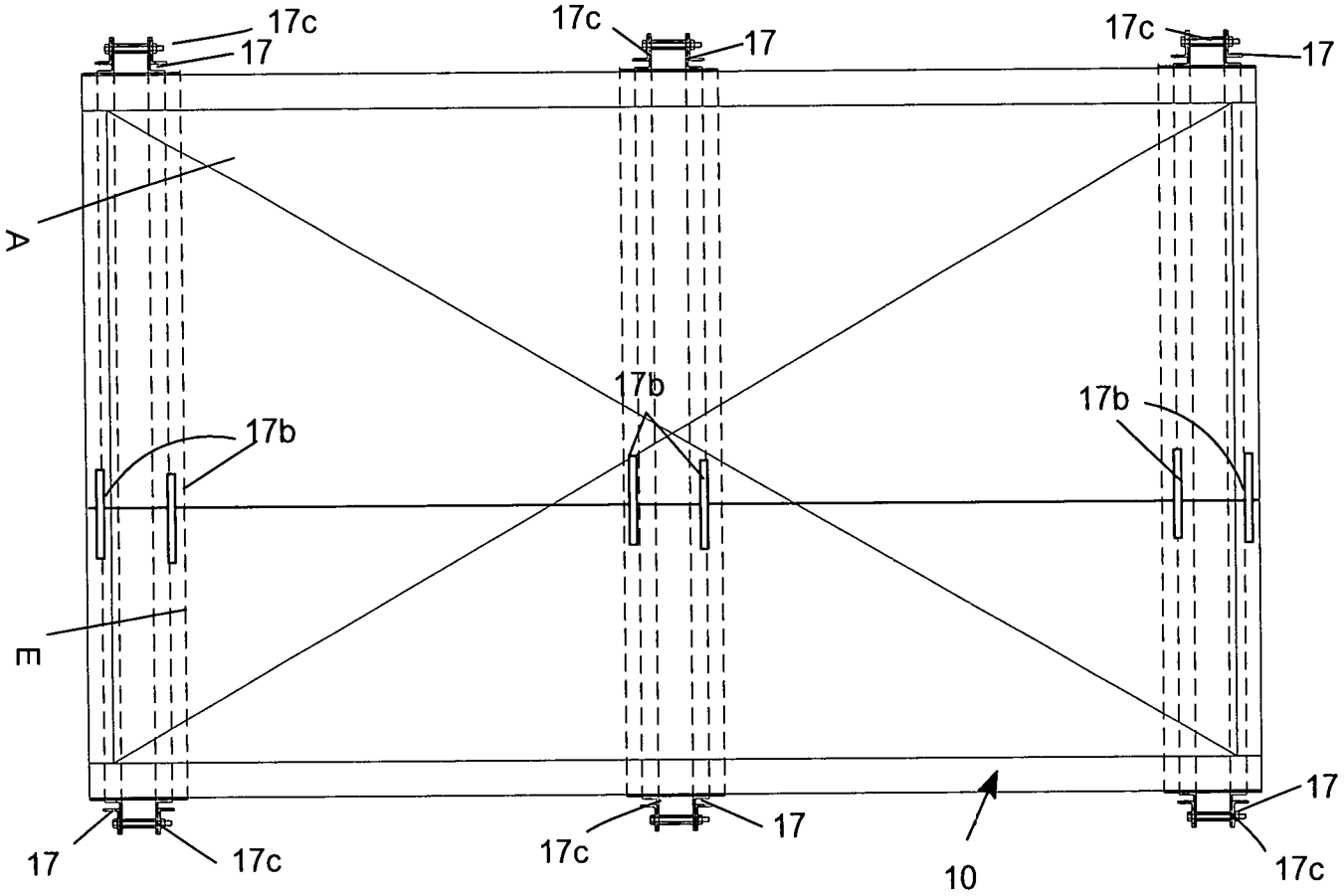
FIG. 7*a* is a top view of the bottom of the closed crate.

FIG. 7*a* is a top plan view of the closed crate. Here, the segments A and E make up the top of the crate as shown. The shipping angles 17*a*, latches 17*b* and the corner shipping brace angles 17*c* that are part of the outer layer of braces 17 are shown.

Figure 8:
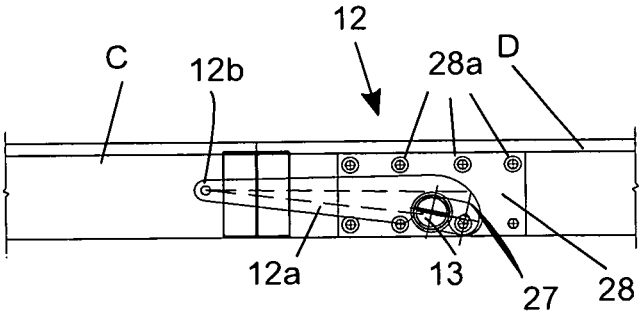
FIG. 8 is a side view of the hinge assembly in a flat, locked position.

FIG. 8 is a side view of the hinge assembly 12 in a flat, locked position. Note that, as discussed above, the hinge assemblies 12 are used to connect two of the flooring segments. For example, segments C and D as shown. Each hinge assembly 12 consists of several pieces. First is a cam arm 12*a*, which is attached to one segment (here segment C) by a pivot 12*b*. The cam arm 12*a* is removably attached to a torque tube 13. Each torque tube 13 has a torque bushing 27, welded to it at each hinge location. Each torque bushing 27 has an arm 29 attached to it that acts as a cam, as discussed below see, FIG. 23. A plate 28, which is secured by fasteners 28*a* adds strength to the frame where the torque tubs exit the frame. These pieces are discussed in more detail below. As shown, the segments are locked. As shown in FIG. 5, there are three hinges 12 for each torque tube 13. Fig the configuration of FIG. 5, there are a total of 12 hinges 12. Note that the plates 28 are only mounted to the side face of the frame as shown in FIG. 3, for example.

Figure 9:
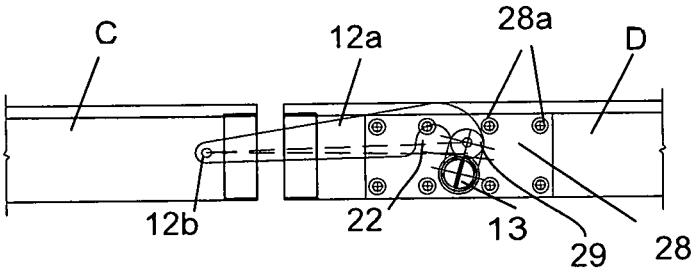
FIG. 9 is a side detail view of the hinge assembly opening up.

To rotate a segment to make the crate (or to open the floor) the torque tube is rotated. This causes the torque bushings 27 to rotate causing the cams 29 to lift the cam arms 12*a* off the torque tube 13 as shown in FIG. 9, which is a side detail view of the hinge assembly opening up. As the torque tube 13 further rotated, it lifts the cam arm 12*a* over the torque tube 13, which causes the segments to separate slightly as shown. Once the segments have opened up, they can be rotated. Note that the notch 22 in the cam arm 12*a* fits over the torque tubes 13 when the hinge is locked.

Figure 10:
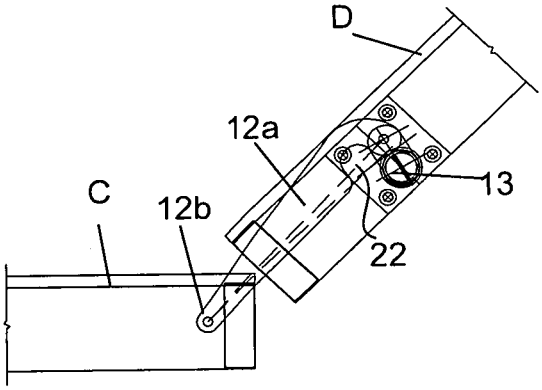
FIG. 10 is a side detail of the hinge assembly rotation.

FIG. 10 is a side detail of the hinge assembly rotation. Here, segment D is shown rotating upward. Note the position of the cam arm 12*a* with respect to the torque tube 13. The two components are static with respect to each other in this position. The cam arm 12*a* rotates about the pivot 12*b*.

Figure 11:
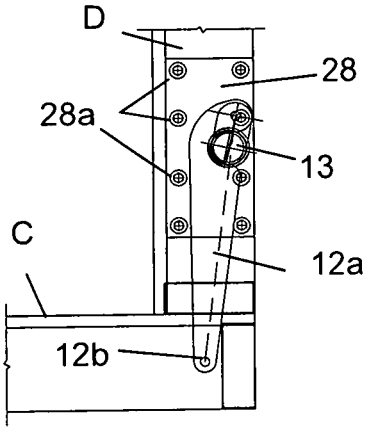
FIG. 11 is a side detail of the hinge assembly in up right locked position.

FIG. 11 is a side detail of the hinge assembly in upright locked position. Once the segment is fully rotated, it is positioned as shown. Note that as segment D completes its rotation, the segments close up, which causes the torque tube to rotate the cam arm 12*a* so that, connected to the cam 29, the cam arm 12*a* slides up, and back down until the notch 22 in the cam arm 12*a* is on top of the torque tube 13. When that happens, the cam arm 12*a* is then locked into position. Compare the cam arm 12*a* and the torque bushing 27 (and cam 29) in FIG. 8 versus FIG. 11. The only difference is that the assembly on segment D is rotated 90 degrees. In the same manner, only in reverse, the segments can be rotated open to make the floor.

Details of the specific components of the system are discussed below.

Figure 12:
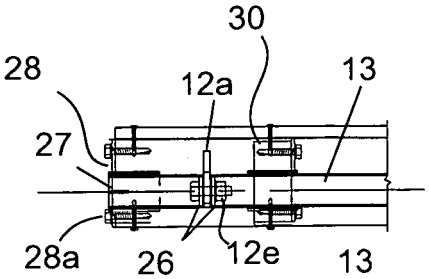
FIG. 12 is the section view through the torque tube, cam arm, toque arms and the torque bushing connection to the steel framing and the ends of the floor panel taken along the lines 12-12 of FIG. 5.

FIG. 12 is the section view through the torque tube 13, cam arm 12*a*, torque bushing 12*c* and the torque bushing connection 28 to the steel framing and the ends of the floor panel taken along the lines 12-12 of FIG. 5. In this view, the front edge section of the floor is shown. Here the plate 28 is shown fastened to the outer steel framing with fasteners through the holes 28*a* (see FIG. 20). The cam arm 12*a* is shown secured to the cam 29 of the torque bushing 27 through the hole 26 (see FIG. 19) with fasteners 12*e*. Note that the torque tube 13 extends across the floor as shown in FIG. 5. Note how the torque tube is supported by the framing member 30.

Figure 13:
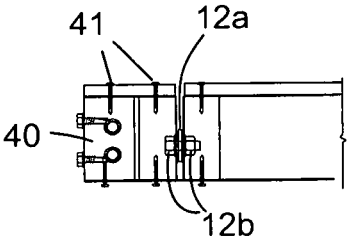
FIG. 13 is the section view through the cam arm to steel frame connection at the ends of the floor panels taken along the 13-13 of FIG. 5.

FIG. 13 is the section view through the cam arm to steel frame connection at the ends of the floor panels taken along the 13-13 of FIG. 5. This view is looking back at the cam arm connection to the pivot 12*b*. The fasteners 12*b* make up the pivot about which the cam arm 12*a* rotates. This figure also shows some of the framing 40 and fasteners 41 associated with it.

Figure 14:
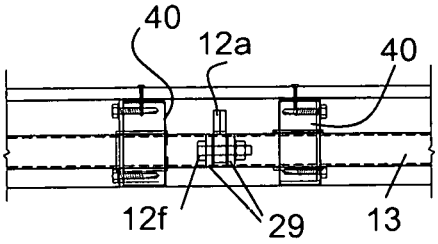
FIG. 14 is a section view through the torque tube, cam arm, toque arms and the torque bushing connection to the steel framing and the center of the floor taken along the lines 14-14 of FIG. 5.

FIG. 14 is a section view through the torque tube, cam arm, toque arms and the torque bushing connection to the steel framing and the center of the floor taken along the lines 14-14 of FIG. 5. In this view, there is no plate 28 that is placed at the outer wall of the floor frame. Note the torque tube 13 passes through the framing 40. Note the cam arm 12*a* that is held by fasteners, as before. Note that the hinges in the center of the floor operate the same as those on the end of the floor sections.

Figure 15:
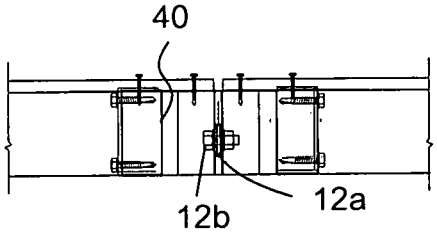
FIG. 15 is a section view through the cam arm to steel frame connection at the center of the floor taken along the lines 15-15 of FIG. 1.

FIG. 15 is a section view through the cam arm to steel frame connection at the center of the floor taken along the lines 15-15 of FIG. 5. This view, like FIG. 13, looks at the cam arm and hinge from the other side of the joint. Here, the end of the cam arm, 12*a* is shown with fasteners 12*b* that act as the pivot for the cam arm.

Figure 16:
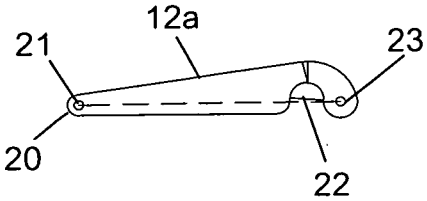
FIG. 16 is a side view of the cam arm.

FIG. 16 is a side view of the cam arm. The cam arm 12*a* is a shaped member having a narrow end 20 with a hole 21 for a pivot pin. A notch 22 is formed near the opposite end of the cam arm 12*a* as shown. This notch 22 fits over the torque tube 13 when the hinge is locked, as discussed above. Note another pin hole 23 is formed at the end as shown.

Figure 17:
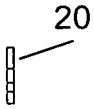
FIG. 17 is a section through the end of the cam arm.

FIG. 17 is a section through the narrow end of the cam arm 20 that shows this end is made of thinner material than the center of the cam arm.

Figure 18:
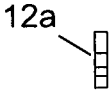
FIG. 18 is section through the center cam arm.

FIG. 18 is section through the center cam arm 12*a*. Note that at this point the cam arm is made of thicker material.

Figure 19:
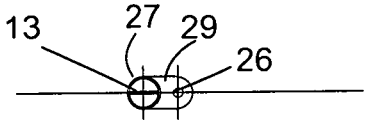
FIG. 19 is a front view of a torque tube and torque arms.

FIG. 19 is a front view of a torque tube 13 showing a bushing 27 that is welded in place to the torque tube. The bushing 27 has a cam 29 and a through the hole 26 to attach the cam arm to the cam through hole 23 with fasteners 12*f*, as discussed above. To see the attachment, see, for example, FIGS. 8-11.

Figure 20:
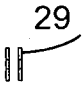
FIG. 20 is section view of the end of the cam on the torque bushing.

FIG. 20 is section view of the end of the torque bushing cam 29.

Figure 21:
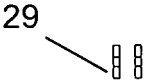
FIG. 21 is section view of the center of the cam on the torque bushing.

FIG. 21 is section view of the center of the cam 29 on the torque bushing 27.

Figure 22:
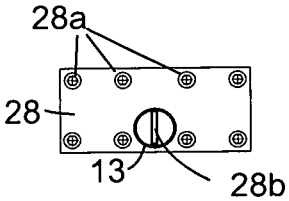
FIG. 22 is front elevation view of a torque tube sleeve or bushing connection plate.

FIG. 22 is front elevation view of a torque tube sleeve or bushing connection plate. The plate 28 has a number of holes 28*a* for fasteners as shown. A large hole is also formed as shown to hold the torque tube 13. Note that this view also shows the torque tube tool flange 28*b*, which is used to connect a tool, such as a wrench to power tool, to apply torque to the torque tube 13 to rotate it.

As designed, the floor is sized to fit a building that has a small front porch. A set of steps, as needed (not shown), can be added to access the porch and building. Of course, a building can take up the entire floor space as well. However, the porch option is the preferred embodiment.

As noted above, the floor is designed to support my panelized portable structure found in U.S. Pat. No. 8,615,934. However, any similar type of building-including regular stick frame constructions can be fitted to this floor-provided normal weight and load limits are met. The floor as a crate is designed to hold parts for the panelized portable structure found in U.S. Pat. No. 8,615,934. For other types of buildings, it can be used to hold building materials as well. Whether or not it holds all of the necessary materials will depend on the specific structure.

Once the crate is loaded, it can be placed on a semitrailer and hauled to a site. The foundation, is pre-built, as discussed above. The crate can then be lifted off the trailer and positioned on the foundation. Then, it can be opened and set up as a floor. The building materials can be then set up to make a building as desired.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A flooring system for use with a pre-built foundation, comprising:

a) a plurality of floor segments, each of said plurality of floor segments having a front face, a first end and a second end, said plurality of floor segments having n number of segments ending in an nth element and wherein a floor element immediately preceding the nth element is an n−1 element;

b) a first plurality of hinges attached to the second end of one of said plurality of floor segments and to the first end of a second of said plurality of floor segments;

c) a second plurality of hinges attached to the second end of the second of said plurality of floor segments and to the first end of a third of said plurality of floor segments;

d) a third plurality of hinges attached to the second end of the third of said plurality of floor segment and to the first end of a fourth of said plurality of floor segments;

e) a nth plurality of hinges attached to the second end of the n−1 segment of said plurality of floor segments and to the first end of said nth segment of said plurality of floor segments; and f) a fastening means attached said first segment of said plurality of floor segments, and a fastening means attached to said second end of the nth segment of said plurality of floor segments;

g) such that said plurality of floor segments has a first position, forming a horizontal floor, an intermediate position, and final position, forming a closed box having two open ends.

2. The flooring system of claim 1 wherein each of said plurality of hinges comprises:

a) a torque tube; installed in one of said floor segments;

b) a bushing attached to said torque tube; said bushing having a cam attached thereto;

c) a cam arm being generally triangular in shape, having an apex and a base portion, and further wherein the apex of said cam arm having a pivot hole formed therein, and further wherein the base portion has a cam notch formed therein to receive said torque tube;

d) wherein the apex of said cam arm being pivotably attached to an abutting floor segment; and e) further wherein said base portion is rotatably attached to said cam on said bushing.

3. The flooring system of claim 2 wherein each of said plurality of hinges has a first position and a second position and further wherein when each of said plurality of hinges is in said first position, said cam arm is in a horizontal orientation, and when each of said plurality of hinges is in said second position, said cam arm is in a vertical orientation.

4. The flooring system of claim 2 wherein each of said plurality of hinges further includes:

a) a plate, attached to the front face of the floor segment having a torque tube installed, said plate having a hole formed therein; and b) a torque tool face, installed in the hole on said plate to receive said torque tube, said torque tool face having a flange to attach a tool thereon.

5. The flooring system of claim 2 wherein when said cam notch is on said torque tube, said hinge is locked.

6. The flooring system of claim 5 wherein when said cam arm is in a horizontal orientation and said cam notch is locked on said torque tube, said hinge is locked in a horizontal position, and when said cam arm is in a vertical orientation and said cam notch is locked on said torque tube, said hinge is locked in a vertical position.

7. The flooring system of claim 6 wherein when said cam notch is off of said torque tube, said floor section can be rotated from a horizontal position to a vertical position or to a horizontal position from a vertical position.

8. The flooring system of claim 7 wherein when said plurality of hinges are in a in a vertical position, said flooring system is in said final position, forming a box.

9. A flooring system comprising:

a) a first floor segment, having a front face, a first end and a second end, and a plurality of framing elements installed therein;

b) a second floor segment, having a front face, a first end and a second end, and a plurality of framing elements installed therein, said second floor element being positioned such that the second end of said second floor element abuts the first end of said first floor element;

c) a third floor segment, having a front face, a first end and a second end, and a plurality of framing elements installed therein, said third floor element being positioned such that the first end of said third floor element abuts the second end of said first floor element;

d) a fourth floor segment, having a front face, a first end and a second end, and a plurality of framing elements installed therein, said fourth floor element being positioned such that the second end of said fourth floor element abuts the first end of said second floor element;

e) a fifth floor segment, having a front face, a first end and a second end, and a plurality of framing elements installed therein, said fifth floor element being positioned such that the second end of said third floor segment abuts the first end of said fifth floor segment;

f) a first plurality of hinges attached to the first end of said first floor segment and the second end of said second floor element;

g) a second plurality of hinges attached to the second end of the first floor segment and to the first end of the third floor segment;

h) a third plurality of hinges attached to the first end of the second floor segment and to the second end of the fourth floor segment;

i) a fourth plurality of hinges attached to the second end of the third floor segment and to the first end of the fifth floor segment;

j) a fastening means attached said first end segment of said fourth floor segment, and a fastening means attached to said second end of the fifth floor segment;

k) a torque tube; installed in one of said floor segments;

l) a bushing attached to said torque tube; said bushing having a cam attached thereto;

m) a cam arm being generally triangular in shape, having an apex and a base portion, and further wherein the apex of said cam arm having a pivot hole formed therein, and further wherein the base portion has a cam notch formed therein to receive said torque tube;

n) wherein the apex of said cam arm being pivotably attached to an abutting floor segment; and o) further wherein said base portion is rotatably attached to said cam on said bushing.

10. The flooring system of claim 9 wherein:

a) the first plurality of hinges is ganged;

b) the second plurality of hinges is ganged;

c) the third plurality of hinges is ganged; and d) the fourth plurality of hinges is ganged.

11. The flooring system of claim 9 wherein each of said plurality of hinges has a first position and a second position and further wherein when each of said plurality of hinges is in said first position, said cam arm is in a horizontal orientation, and when each of said plurality of hinges is in said second position, said cam arm is in a vertical orientation.

12. The flooring system of claim 11 wherein when said cam notch is on said torque tube, said hinge is locked.

13. The flooring system of claim 12 wherein when said cam arm is in a horizontal orientation and said cam notch is locked on said torque tube, said hinge is locked in a horizontal position, and when said cam arm is in a vertical orientation and said cam notch is locked on said torque tube, said hinge is locked in a vertical position.

14. The flooring system of claim 13 wherein when said cam notch is off of said torque tube, said floor section can be rotated from a horizontal position to a vertical position or to a horizontal position from a vertical position.

15. The flooring system of claim 13 wherein when said plurality of hinges are in a in a vertical position, said flooring system forms a box having an outer perimeter.

16. The flooring system of claim 15 further comprising a pair of end panels, attached to said box.

17. The flooring system of claim 16 further comprising a plurality of shipping angles attached to the outer perimeter of said box.

18. The flooring system of claim 9 wherein each of said plurality of hinges further includes a pivot secured to said flooring system and to said cam arm such that said cam arm can rotate about said pivot.

19. The flooring system of claim 18 wherein each of said plurality of hinges further includes:

a) a plate, attached to the front face of the floor segment having a torque tube installed, said plate having a hole formed therein; and b) a torque tool face, installed in the hole on said plate to receive said torque tube, said torque tool face having a member to attach a tool thereon.

* * * * *